US009466869B2

(12) United States Patent
Tian et al.

(10) Patent No.: US 9,466,869 B2
(45) Date of Patent: Oct. 11, 2016

(54) OPTIMAL DIRECTION DETERMINATION OF RADIO SIGNALS

(71) Applicant: Empire Technology Development LLC, Wilmington, DE (US)

(72) Inventors: Li Tian, Shanghai (CN); Xuefeng Yin, Shanghai (CN)

(73) Assignee: EMPIRE TECHNOOGY DEVELOPMENT LLC, Wilmington, DE (US)

( * ) Notice: Subject to any disclaimer, the term of this patent is extended or adjusted under 35 U.S.C. 154(b) by 0 days.

(21) Appl. No.: 14/386,644

(22) PCT Filed: Sep. 6, 2013

(86) PCT No.: PCT/CN2013/083067

§ 371 (c)(1),
(2) Date: Sep. 19, 2014

(87) PCT Pub. No.: WO2015/032074

PCT Pub. Date: Mar. 12, 2015

(65) Prior Publication Data

US 2016/0240911 A1 Aug. 18, 2016

(51) Int. Cl.

| | |
|---|---|
| ***H01Q 3/00*** | (2006.01) |
| ***H01Q 1/12*** | (2006.01) |
| ***H01Q 1/24*** | (2006.01) |

(52) U.S. Cl.

CPC ..... *H01Q 1/1257* (2013.01); *H01Q 1/243* (2013.01)

(58) Field of Classification Search

CPC ..... H01J 37/1471; H01J 2237/055; H01J 2237/1501; H01J 2237/24507; H01J 2237/24528; H01J 2237/3045; H01Q 21/005; H01Q 3/04

USPC ..... 342/359, 368, 372, 378, 379; 343/753, 343/754, 756, 757, 765, 853; 455/562.1

See application file for complete search history.

(56) References Cited

U.S. PATENT DOCUMENTS

| | | | | |
|---|---|---|---|---|
| 4,771,289 | A * | 9/1988 | Masak | H01Q 3/2617 342/378 |
| 5,463,401 | A * | 10/1995 | Iwasaki | H01Q 1/1257 342/359 |
| 6,950,061 | B2 * | 9/2005 | Howell | H01Q 1/3275 342/359 |
| 7,109,937 | B2 * | 9/2006 | Iluz | H01Q 1/18 343/756 |
| 7,277,730 | B2 * | 10/2007 | Ylitalo | H04W 16/28 455/101 |
| 7,339,520 | B2 * | 3/2008 | Chang | H01Q 1/3275 342/359 |

(Continued)

FOREIGN PATENT DOCUMENTS

| | | |
|---|---|---|
| CN | 1585297 A | 2/2005 |
| CN | 101094021 A | 12/2007 |

(Continued)

OTHER PUBLICATIONS

"Maximizing LTE Performance Through MIMO Optimization," Pctel, White Paper, pp. 1-14 (Apr. 2011).

(Continued)

*Primary Examiner* — Tho G Phan

(74) *Attorney, Agent, or Firm* — Brundidge & Stanger, P.C.

(57) ABSTRACT

Mobile communication devices, e.g., cellphones, may integrate an antenna array that includes one or more antenna to form radio beams at a preferred direction and a signal locator to identify coordinates corresponding to a strongest signal strength and direct the antenna array towards the strongest single strength.

18 Claims, 7 Drawing Sheets

(56) References Cited

U.S. PATENT DOCUMENTS

| | | | | |
|---|---|---|---|---|
| 7,522,114 | B2 | 4/2009 | Brown et al. | |
| 7,587,173 | B2 | 9/2009 | Hoffmann et al. | |
| 7,880,675 | B1 * | 2/2011 | Paschen | H01Q 3/2617 342/372 |
| 7,956,806 | B2 * | 6/2011 | Liu | H04B 7/086 342/359 |
| 8,204,507 | B2 | 6/2012 | Yu et al. | |
| 8,604,982 | B2 | 12/2013 | Achour et al. | |
| 8,699,372 | B2 | 4/2014 | Guo | |
| 2003/0179138 | A1 | 9/2003 | Chen | |
| 2006/0256014 | A1 | 11/2006 | Sengupta et al. | |
| 2007/0105594 | A1 | 5/2007 | Burkert et al. | |
| 2008/0076477 | A1 | 3/2008 | Hedayat et al. | |
| 2010/0073232 | A1 | 3/2010 | Sajuyigbe et al. | |

FOREIGN PATENT DOCUMENTS

| | | | |
|---|---|---|---|
| CN | 101237267 | A | 8/2008 |
| CN | 101501927 | A | 8/2009 |
| JP | 2006211328 | A | 8/2006 |
| JP | 2007081825 | A | 3/2007 |
| JP | 2007525065 | A | 8/2007 |
| JP | 2009535942 | A | 10/2009 |
| WO | 9836595 | A | 8/1998 |
| WO | 2004114546 | A1 | 12/2004 |
| WO | 2007127955 | A2 | 11/2007 |
| WO | 2008115881 | A1 | 9/2008 |
| WO | 2010130166 | A | 11/2010 |

OTHER PUBLICATIONS

"New EU project on ferroelectric films," Accessed at http://www.nanotechwire.com/news.asp?nid=2701&ntid=115&pg=86, Dec. 18, 2005, pp. 2.

Abdulrazak, L. F. et al., "New Algorithm to Improve the Coexistence between IMT-Advanced Mobile Users and Fixed Satellite Service," 2009 International Conference on Machine Learning and Computing, IPCSIT, IACSIT Press, Singapore, vol. 3, pp. 294-301 (2011).

Bartlett, M., "Smoothing periodograms from time series with continuous spectra," Nature, vol. 161, pp. 686-687 (1948).

Bhagavatula, R. & Heath, R., Jr. , "Adaptive Limited Feedback for Sum-Rate Maximizing Beamforming in Cooperative Multicell Systems," Signal Processing, IEEE Transactions on, Feb. 2011, vol. 59, No. 2, pp. 800-811.

Fleury, B. H., "Channel Parameter Estimation in Mobile Radio Environments Using the SAGE Algorithm," IEEE Journal on Selected Areas in Communications, vol. 17, No. 3, pp. 434-450 (1999).

Gaokar, R. and Cheeran, A., DR., "Performance Analysis of Beamforming Algorithms," IJECT, vol. 2, No. 1, Mar. 2011, pp. 43-48.

International search report and written opinion for PCT Application No. PCT/CN2010/074051 mailed Mar. 24, 2011.

International search report and written opinion for PCT Publication No. PCT/CN2014/071115 mailed Apr. 23, 2014.

Modelski, J. & Yashchyshyn, Y., "Voltage-controlled ferroelectric microstrip antenna for phased arrays," Antennas and Propagation Society International Symposium, vol. 2, pp. 506-509 (2000).

Park, J. S. et al., "SPACE-MAC: Enabling Spatial Reuse using MIMO channel-aware MAC," Communications, 2005 IEEE International Conference on, vol. 5, May 16-20, 2005, pp. 3642-3646.

Razavilar, J. et al., "Joint beamforming and handoff for traffic improvements in wireless networks," IEEE International Conference on Communications, vol. 1, pp. 41-45 (1999).

Wang, P., "Frequency-fixed beam-scanning leaky-wave antenna based on composite left-right transmission line," Master thesis, Tongji University, (2009), with English Abstract.

Wang, Y., et al., "Direct observation of negative phase velocity and positive group velocity in time domain for composite right/left-handed transmission lines," Journal of Applied Physics, vol. 100, No. 11, pp. 113503-113503-4 (2006).

Xie, N., et al., "Multi-pair Physical Layer Network Coding with Beamforming Systems," IEEE Wireless Communications and Networking Conference (WCNC), pp. 1-5 (2012).

Yin, X. et al., "Tracking of Time-Variant Radio Propagation Paths Using Particle Filtering," IEEE International Conference on Communications, pp. 920-924 (2008).

International Search Report and Written Opinion from PCT/CN13/083067mailed Jun. 4, 2014.

* cited by examiner

OPTIMAL DIRECTION DETERMINATION OF RADIO SIGNALS

CROSS-REFERENCE TO RELATED APPLICATION

This Application is the U.S. National Stage filing under 35 U.S.C. §371 of PCT Application Ser. No. PCT/CN2013/083067 filed on Sep. 6, 2013.

TECHNICAL FIELD

The technologies described herein pertain generally to optimal direction determination in a mobile communication device that integrates an antenna array.

BACKGROUND

Unless otherwise indicated herein, the approaches described in this section are not prior art to the claims in this application and are not admitted to be prior art by inclusion in this section.

Mobile communication devices, e.g., cellphones or smartphones, may integrate an antenna array that includes one or more antennae to form radio beams towards a particular direction in which the antennae may receive strongest signals. The complexity of current algorithms used to determine an optimal direction for projection and reception of radio signals may cause excessive power consumption and lower the battery life of the mobile communication devices.

SUMMARY

Technologies are generally described for optimal direction determination of radio signals. The various techniques may be implemented in various devices, methods and/or systems.

In some examples, various techniques may be implemented on or by devices. Some devices may include a signal locator configured to identify boundaries of a signal spectrum and identify coordinates of a comparative reading of strongest signal strength within the signal spectrum; and multiple antennas configured to direct one or more radio signals towards the identified coordinates.

In some examples, various embodiments may be implemented as methods. Some methods may include identifying boundaries of a signal spectrum in a spherical space; parsing the signal spectrum into multiple grids in accordance with respective variable values of an azimuth and elevation of the antenna array; identifying two or more consecutive time intervals; randomly selecting two or more of the multiple grids for each of the two or more consecutive time intervals; identifying coordinates within each of the two or more grids, at which signal strength is determined to be strongest within the respective one of the two or more grids; identifying a strongest signal strength from among the two or more grids; and directing one or more radio beams towards the identified coordinates corresponding to the identified strongest signal strength during the respective two or more consecutive time intervals.

In some examples, various embodiments may be implemented as computer-readable mediums having executable instructions stored thereon. Some computer-readable mediums may store instructions that, when executed, cause one or more processors to perform operations comprising identifying a strongest signal strength for each of two or more consecutive time intervals, directing one or more radio beams towards coordinates corresponding to the identified strongest signal strength, identifying a new strongest signal strength during a new time interval, and redirecting the one or more radio beams towards new coordinates corresponding to the identified new strongest signal strength.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items. In the drawings.

DETAILED DESCRIPTION

Figure 1:
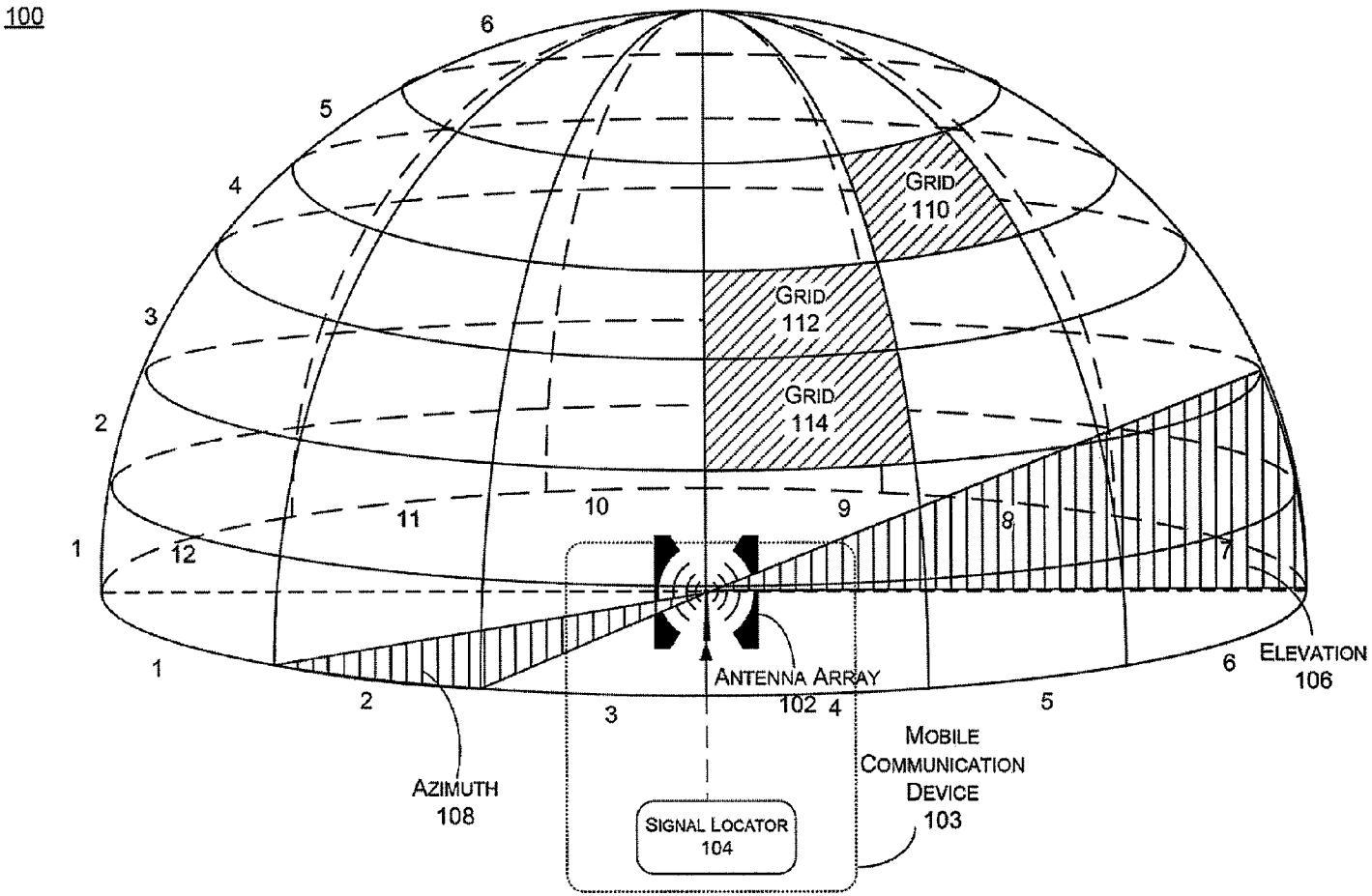
FIG. 1 shows an example environment of radio signals in which optimal direction determination may be implemented.

In the following detailed description, references are made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

In accordance with some example embodiments, a signal locator configured to manage an antenna array of a mobile communication device may first parse an identified signal spectrum into multiple grids and identify global maximum signal strengths from among the parsed grids. Further, in one or more following time intervals, the signal locator may be configured to identify new global maximum signal strength of each of the one or more time intervals and direct the antenna array in response to the new global maximum signal strength.

FIG. 1 shows an example environment 100 of radio signals in which optimal direction determination may be implemented, arranged in accordance with at least some embodiments described herein. As depicted, example environment 100 may include an antenna array 102 managed by a signal locator 104 of a mobile communication device 103 in a spherical space relative to the position of antenna array 102. The spherical space may be parsed, in accordance with respective variable values of an elevation 106 and azimuth 108 of antenna array 102, into multiple grids, e.g., grid 110, grid 112, grid 114, etc.

Antenna array 102 may refer to a physical component of mobile communication device 103, which may integrate antenna array 102 managed by signal locator 104 to form one or more radio beams at different directions. As referenced herein, radio beams may refer to one or more beams of radio signals focused in a particular direction. Each of the group of antennas may be supported with electric currents that are of variable amplitudes and phases so that the directions of the radio beams may be controllable.

Mobile communication device 103 may refer to mobile (or portable) electronic device such as a mobile phone, smartphone, personal digital assistant (PDA) a personal media player device, an application specific device, or a hybrid device that includes any of the above functions. Alternatively, mobile communication device 103 may be implemented as a personal computer including tablet, laptop computer, non-laptop computer configure configurations, etc.

Signal locator 104 may refer to a hardware component, a software component, a firmware component, or a combination thereof of mobile communication device 103 that may be configured to perform arithmetical, logical, and input/output operations. In accordance with some examples, signal locator 104 may be configured to modify the amplitudes and phases of the electric currents through antenna array 102 and, as a result, vary elevation 106 and azimuth 108.

Elevation 106 and azimuth 108 of the directionally controllable radio beams may each refer to an angular measurement in a spherical coordinate system that corresponds to the spherical space relative to antenna array 102. Elevation 106 may refer to an angle between a preferred direction and a local horizon of antenna array 102. Azimuth 108 may refer to an angle between a projected vector of the preferred direction, which may be projected perpendicularly onto the local horizon of antenna array 102 from a vector, i.e., antenna array 102, from the origin of the spherical coordinate system to the preferred direction, and a reference vector on the local horizon of antenna array 102. The reference vector may refer to a vector from the origin to a predetermined spot on the local horizon of antenna array 102. By changing elevation 106 and azimuth 108, antenna array 102 may be configured to point towards any direction in the spherical coordinate system.

Grid 110, grid 112, and grid 114 may each refer to one of multiple grids parsed in a signal spectrum over the spherical coordinate system in accordance with respective variable values of elevation 106 and azimuth 108. In some examples, signal locator 104 may be configured to parse a signal spectrum in the spherical space into multiple grids for the purpose of locating or identifying a strongest signal strength in the signal spectrum. In a non-limiting example depicted in FIG. 1, the signal spectrum may be parsed into twelve sections in accordance with azimuth 108 and six sections in accordance with elevation 106. Thus, grid 110, grid 112, and grid 114 may refer to three of the seventy two grids in the signal spectrum, which may be at the position of the coordinates, (4,3), (4,4), (5,5). In some examples, the size of each grid may be determined by an aperture of each antenna of antenna array 102.

Thus, FIG. 1 shows an example environment 100 that may include an antenna array 102 managed by a signal locator 104 in a spherical space that may be parsed in to multiple grids, e.g., grid 110, grid 112, grid 114, etc., in accordance with respective variable values of elevation 106 and azimuth 108.

Figure 2:
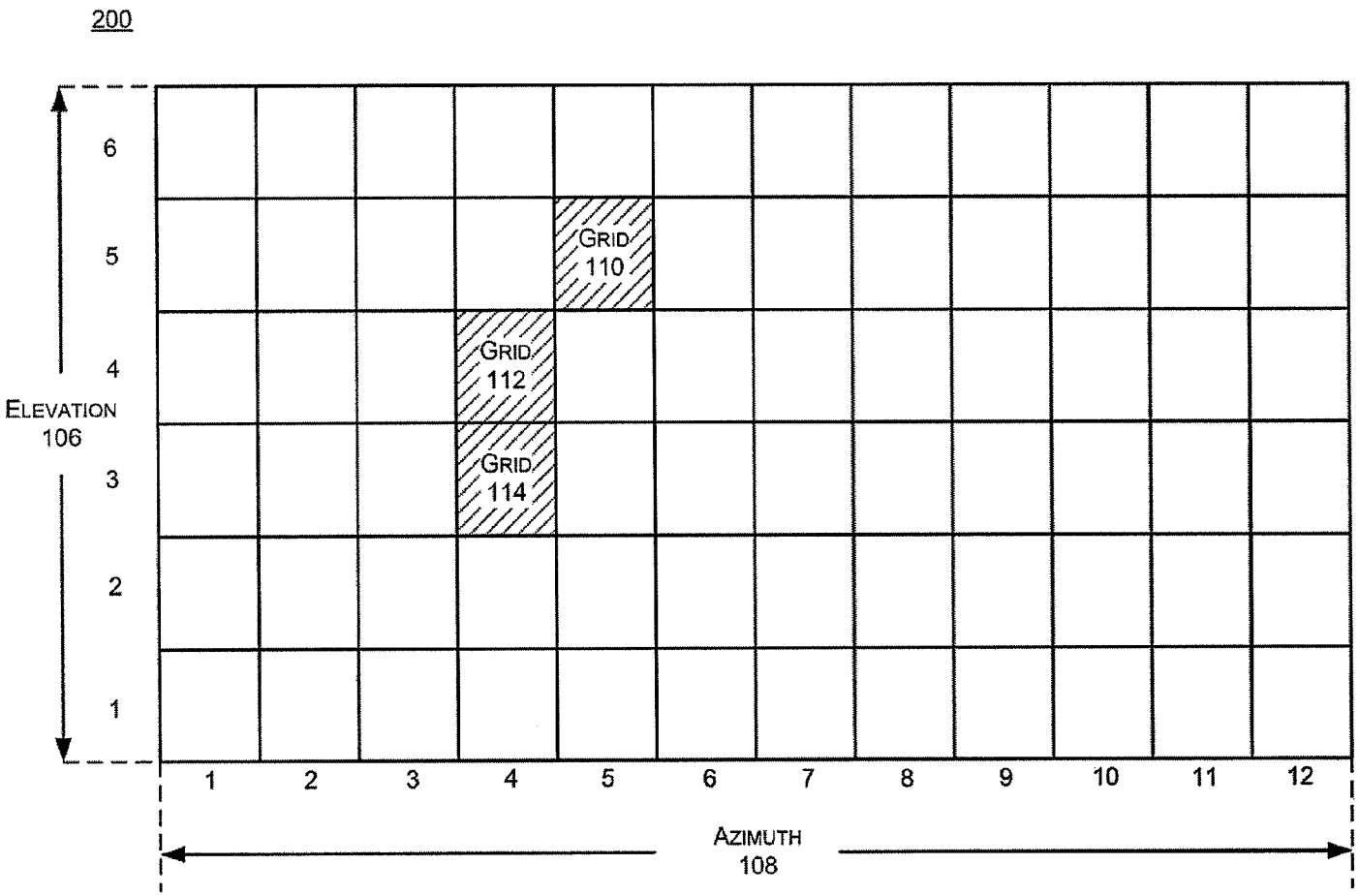
FIG. 2 shows an example signal spectrum by which optimal direction determination may be implemented.

FIG. 2 shows an example signal spectrum 200 by which optimal direction determination may be implemented, arranged in accordance with at least some embodiments described herein. As depicted, example signal spectrum 200 may include multiple grids, e.g., grid 110, grid 112, and grid 114, parsed in accordance with variable values of elevation 106 and azimuth 108.

Example signal spectrum 200 may refer to a two-dimension coordinate system that is converted from the spherical coordinate system that depicts the signal spectrum that is depicted and described in regard to FIG. 1. In accordance with some examples, with respect to each of two or more consecutive time intervals, signal locator 104 may be configured to randomly select a predetermined number, e.g., three, of grids from the multiple grids of the two-dimension coordinate system to conduct a search for coordinates at which signal strength is determined to be the strongest within each of the, e.g., three grids of the signal spectrum. In accordance with some examples, signal locator 104 may be configured to adopt a two dimension search method that incorporates a golden section search method in identifying a strongest signal strength within a grid. As referenced herein, golden section search may refer to a search method that may locate a local maximum or minimum value of a function within a given range.

Further, signal locator 104 may be configured to identify coordinates of an overall strongest signal strength among the identified coordinates of the three grids. Accordingly, signal locator 104 may be further configured to direct antenna array 102 towards the coordinates corresponding to the overall strongest signal strength. In some examples, a time interval may refer to the period of time for antenna array 102 to transmit a data frame.

Thus, FIG. 2 shows an example signal spectrum 200 in a two-dimension coordinate system by which optimal direction determination may be implemented, arranged in accordance with at least some embodiments described herein.

Figure 3:
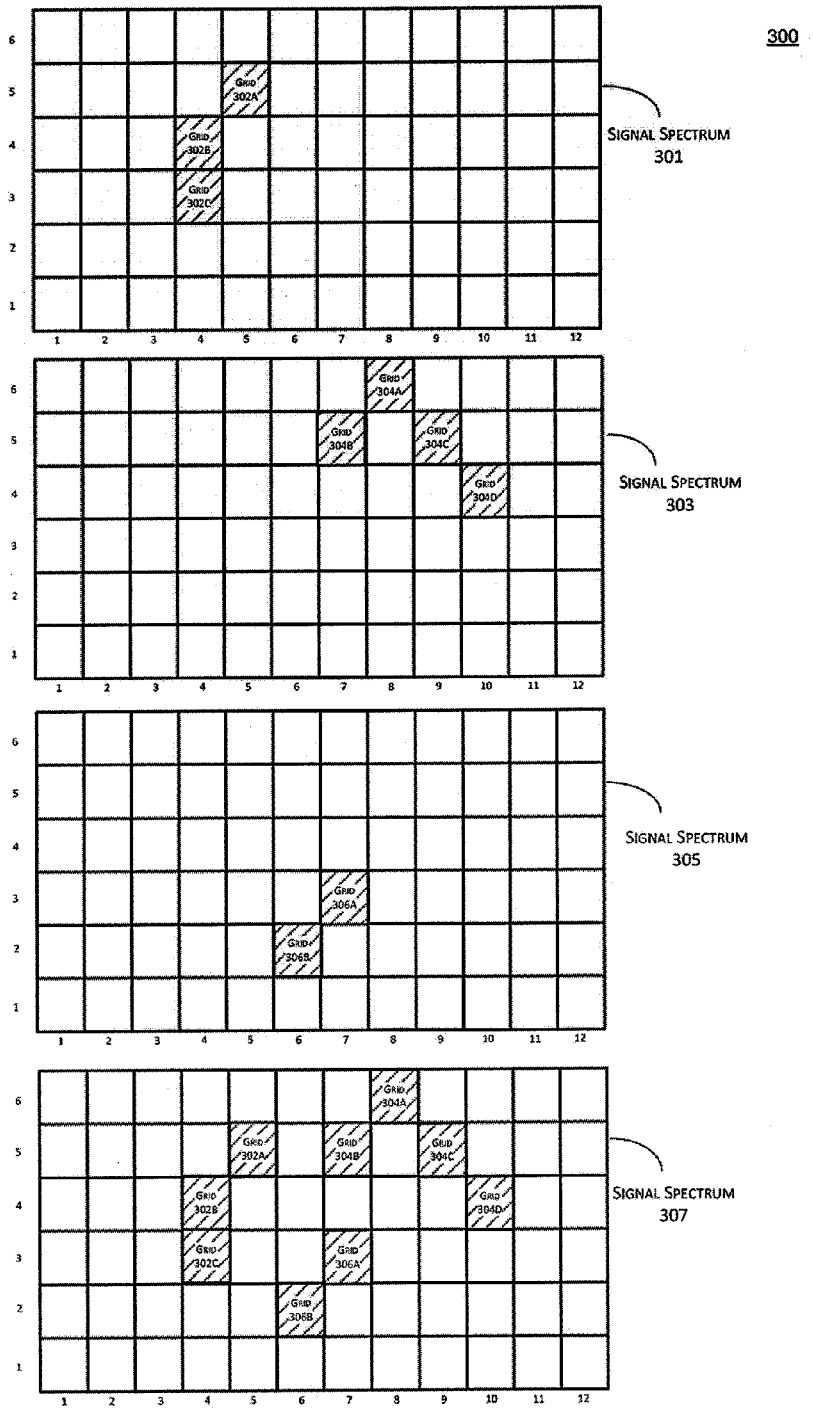
FIG. 3 shows multiple signal spectrums corresponding to multiple time intervals by which optimal direction determination may be implemented.

FIG. 3 shows multiple signal spectrums 300 corresponding to multiple time intervals by which optimal direction determination may be implemented, arranged in accordance with at least some embodiments described herein. As depicted, signal spectrums 300 may include signal spectrums 301, 303, 305, and 307, each of which corresponds to one of one or more, e.g., three, consecutive time intervals. Each of the signal spectrums may further include one or more grids, e.g., grids 302A-302C, grids 304A-304D, grids 306A-306B, etc. Notably, the number of the one or more grids included in each signal spectrum may not be limited to the aforementioned number.

Signal spectrum 301 may refer to the signal spectrum corresponding to the first one of the consecutive time intervals. As described above, signal locator 104 may be configured to randomly select one or more grids from the multiple grids in the signal spectrum, e.g., grids 302A-302C, during the first time interval, and to locate the coordinates of the strongest signal strength within each grid. In some other examples, alternatively, signal locator 104 may be configured to conduct a global search within each of the multiple grids to identify one or more grids (e.g., three grids) in which three strongest signal strengths are respectively located and, similarly, to locate the coordinates of the strongest signal strength within each grid. Further, signal locator 104 may be configured to identify the coordinates of an overall strongest signal strength among the identified coordinates and to direct antenna array 102 towards the overall strongest signal strength during the first time interval.

Similar to signal spectrum 301, signal spectrum 303 and 305 may refer to the signal spectrums corresponding to the second and third one of the consecutive time intervals. Similarly, during each of the second and third time interval, signal locator 104 may be configured to randomly select one or more grids from the multiple grids in the signal spectrum, e.g., grids 304A-304D, grids 306A-306B, during each of the second and third time interval, and to locate the coordinates of the strongest signal strength within each grid. Similarly, in other examples, signal locator 104 may be alternatively configured to conduct another global search within each of the multiple grids to identify one or more grids in which a corresponding number of strongest signal strengths are respectively located and to locate the coordinates of the strongest signal strength within each grid. Signal locator 104 may also be configured to identify the coordinates of an overall strongest signal strength among the identified coordinates within respective time interval and to direct antenna array 102 towards the respective overall strongest signal strength.

Signal spectrum 307 may refer to the signal spectrum corresponding to a time interval that follows the aforementioned one or more time intervals, e.g., the fourth time interval. During the fourth interval, signal locator 104 may be configured to compile the one or more grids that have been selected during the previous three intervals or together with one or more randomly selected additional grids (not shown). That is, signal locator 104 may be configured to select grids 302A-302C, grids 304A-304D, grids 306A-306B, and conduct a search for the coordinates of an overall strongest signal strength among the nine grids. Since signal locator 104 has identified the coordinates of a strongest signal strength within each of the nine grids during each of the previous time intervals, signal locator 104 may be configured to list the strongest signals strengths corresponding to each of the compiled grids and to select a predetermined number of grids, e.g., three, from the nine grids, which correspond to three strongest signal strength, in descending order from the highest of the listed signal strengths. Signal locator 104 may then be configured to search for a new strongest signal strength within each of the selected grids and, further, identify a new overall strongest signal strength during the fourth time interval. Antenna array 102 may then be redirected towards the new overall strongest signal strength during the fourth time interval.

Thus, FIG. 3 shows multiple signal spectrums 300 corresponding to multiple time intervals by which optimal direction determination may be implemented.

Figure 4:
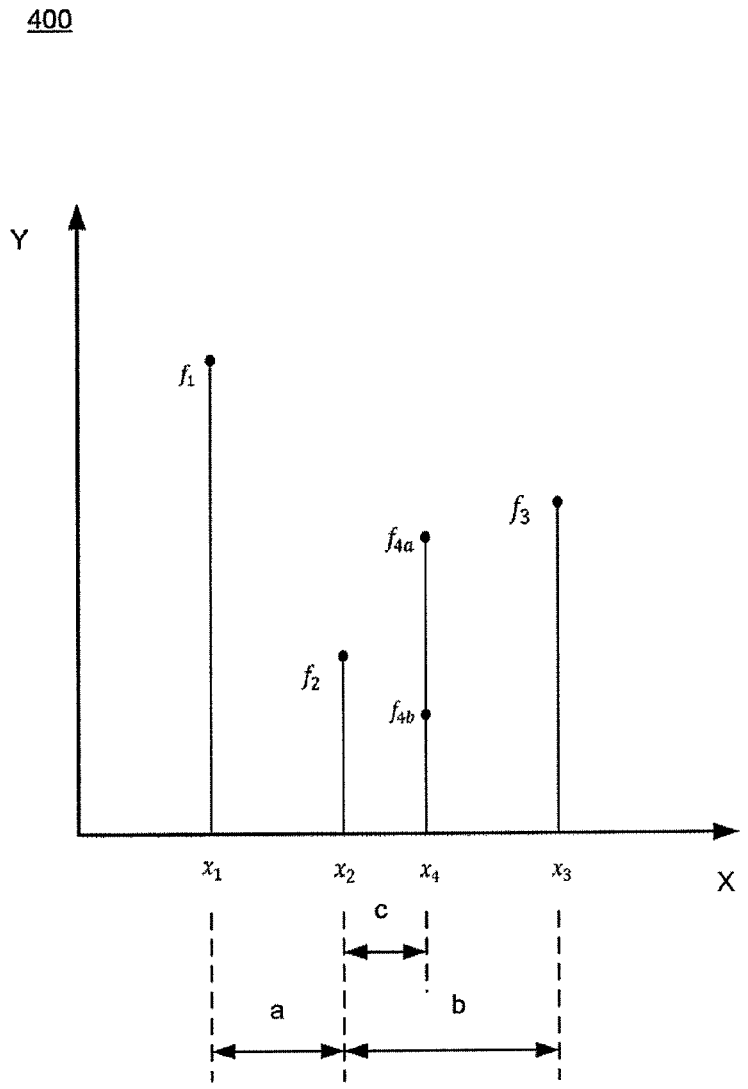
FIG. 4 shows an example golden section search method by which optimal direction determination may be implemented.

FIG. 4 shows an example golden section search method 400 by which optimal direction determination may be implemented, arranged in accordance with at least some embodiments described herein. As depicted, golden section search method 400 may refer to an optimal search method used to locate local minimum value by repeatedly narrowing down the range in which the local minimum value may exist. The golden section search method may also be used to locate a local maximum value. The horizontal axis is the x parameter when the functional values of f (x) are placed on the vertical axis. Initially, the value of f(x) is evaluated at three points: $x_1$, $x_2$, $x_3$. The respective values of f(x) are $f_1$, $f_2$, $f_3$.

Since the distance between $x_2$ and $x_3$, "b" as shown, is larger than the distance between $x_1$ and $x_2$, "a" as shown, a new value $x_4$ may be chosen between $x_2$ and $x_3$. If the functional value at $x_4$ yields a value larger than $f_2$, e.g., $f_{4a}$, the new range to identify the local minimum value may then be between $x_1$ and $x_4$. If the functional value at $x_4$ yields a value smaller than or equal to $f_2$, e.g., $f_{4b}$, the new range to identify the local minimum value may then be between $x_2$ and $x_3$. Thus, the range in which a local minimum value may exist is narrowed. By repeating the method, a local minimum value may be located. To simplify the searching process, in at least one example, the range in which a local minimum value may exist may be narrowed to be between $x_2$ and $x_3$ if $f_3$ takes a minimum value among $f_1$, $f_2$, $f_3$ and $f_{4a}/f_{4b}$; similarly, the range may be narrowed to be between $x_1$ and $x_4$ if $f_1$ takes a minimum value among $f_1$, $f_2$, $f_3$ and $f_{4a}/f_{4b}$.

To improve the efficiency of the repeating performance of the search method, the distance between $x_1$ and $x_2$ is preferred to meet $$\frac{b}{a} = \frac{1+\sqrt{5}}{2} = 1.618033988 \ldots$$

1.618033988 . . . . Similarly, the distance between $x_2$ b-c and $x_4$ is preferred to meet $$\frac{b-c}{c} = \frac{1+\sqrt{5}}{2} = 1.618033988 \ldots$$

1.618033988 . . . . In some examples, $$\frac{1+\sqrt{5}}{2}$$

may be referred as the golden ratio and may be simplified as 1.6, 1.61, or 1.618.

Thus, FIG. 4 shows an example golden section search method 400 by which optimal direction determination may be implemented.

Figure 5:
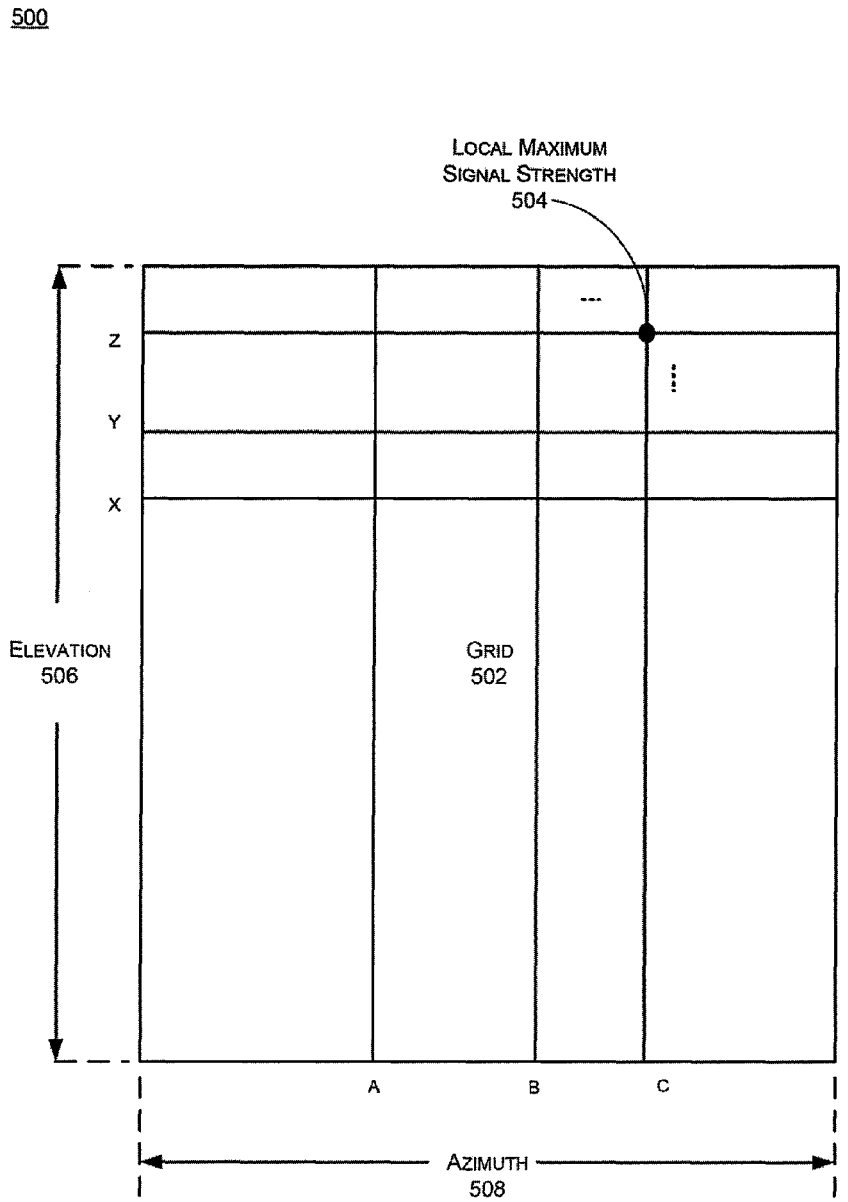
FIG. 5 shows an example two dimension search method by which optimal direction determination may be implemented.

FIG. 5 shows an example two dimensional search method 500 by which optimal direction determination may be implemented, arranged in accordance with at least some embodiments described herein. As depicted, example two dimension search method 500 may be implemented to locate a local maximum signal strength 504 in grid 502, by changing the values of an elevation 506 and an azimuth 508.

Grid 502 may refer to one of the multiple grids selected by signal locator 104, which may be identified in accordance with variable values of elevation 506 and azimuth 508. In a non-limiting example, signal locator 104 may select a value of azimuth 508, e.g., A, and the position of A may separate the value range of azimuth 508 into two sub-ranges that satisfy the golden ratio. Signal locator 104 may then be configured to search for a local maximum signal strength by changing elevation 506 in accordance with the aforementioned golden section search method. Assuming signal locator 104 locates the local maximum signal strength when the value of elevation 506 is x, signal locator 104 may then be configured to change the value of azimuth 508 to local a second maximum signal strength when the value of elevation 506 is fixed as x. The value of azimuth 508 corresponding to the second maximum signal strength may be determined as B. By repeating the search method on both dimensions, i.e., elevation 506 and azimuth 508, signal locator 104 may locate the coordinates of local maximum signal strength 504 in grid 502 when, for example, the value of azimuth 508 is c and the value of elevation 506 is z.

Thus, FIG. 5 shows an example two dimension search method 500 in searching local maximum signal strength 504 in grid 502.

Figure 6:
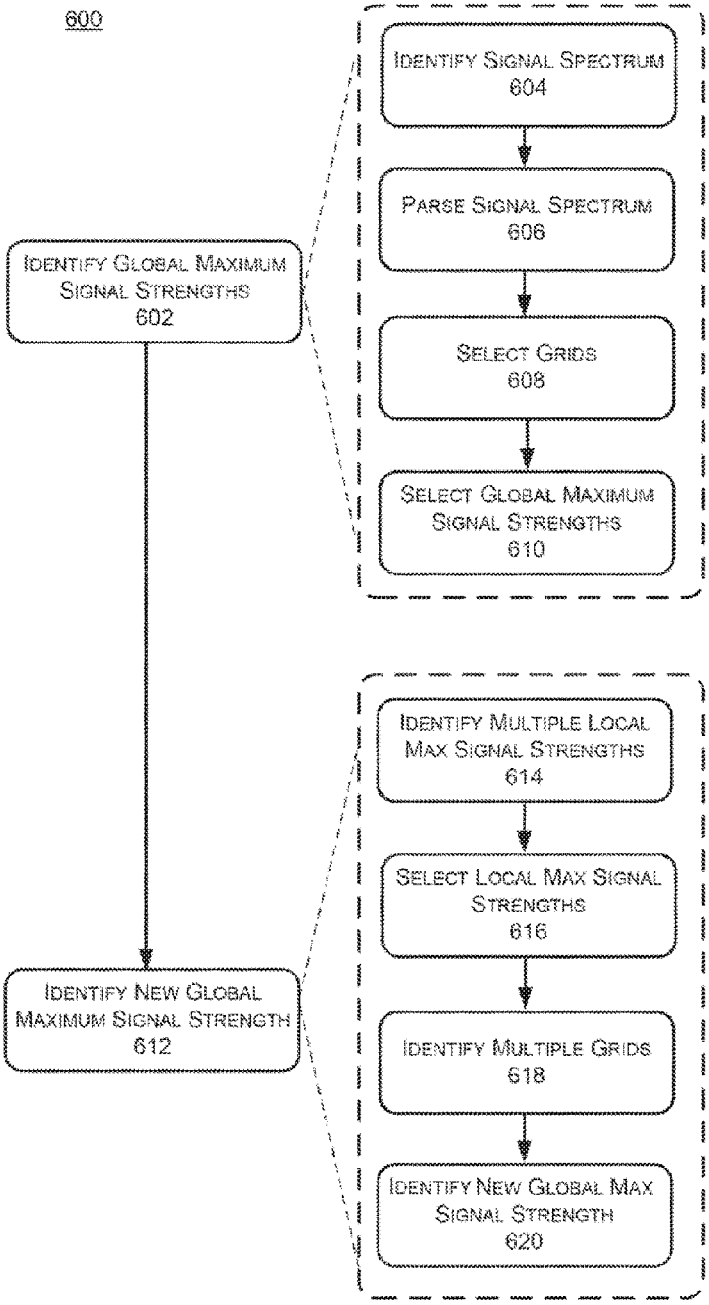
FIG. 6 shows an example configuration of a processing flow of operations by which optimal direction determination may be implemented.

FIG. 6 shows an example configuration of a processing flow 600 of operations by which optimal direction determination may be implemented, arranged in accordance with at least some embodiments described herein. As depicted, processing flow 600 may include sub-processes executed by various components that are part of example environment 100. However, processing flow 600 is not limited to such components, and modification may be made by re-ordering two or more of the sub-processes described here, eliminating at least one of the sub-processes, adding further sub-processes, substituting components, or even having various components assuming sub-processing roles accorded to other components in the following description. Processing flow 600 may include various operation, functions, or actions as illustrated by one or more of blocks 602, 604, 606, 608, 610, 612, 614, 616, 618 and/or 620. Processing may begin at block 602.

Block 602 (Identify Global Maximum Signal Strengths) may refer to signal locator 104 identifying coordinates of an overall strongest signal strength from among one or more grids during each of one or more consecutive time intervals. Block 602 may include one or more sub-processes indicated by block 604, 606, 608, and 610. Processing may proceed from block 602 to block 604.

Block 604 (Identify Signal Spectrum) may refer to signal locator 104 identifying boundaries of a signal spectrum in a spherical space. The signal spectrum may occupy portions of the spherical space or the entire spherical space. For example, as depicted in the FIG. 1, the signal spectrum may occupy the upper hemisphere of the entire spherical space. Processing may continue from block 604 to block 606.

Block 606 (Parse Signal Spectrum) may refer to signal locator 104 parsing the signal spectrum into multiple grids in accordance with respective variable values of elevation 106 and azimuth 108 of antenna array 102. In the non-limiting example depicted in FIG. 1, the signal spectrum may be parsed into twelve sections in accordance with azimuth 108 and six sections in accordance with elevation 106. Processing may continue from block 606 to block 608.

Block 608 (Select Grids) may refer to signal locator 104 randomly selecting two or more, e.g., three, or all of the multiple grids during each of the two or more consecutive time intervals. For example, during the first of the two or more time intervals, signal locator 104 may be configured to randomly select grids 302A-302C to identify coordinates of a strongest signal strength within each grid. Alternatively, signal locator 104 may be configured to select all the multiple grids. Processing may continue from block 608 to block 610.

Block 610 (Select Global Maximum Signal Strengths) may refer to signal locator 104, during each of the two or more consecutive time intervals, identifying coordinates within each of the two or more grids (or all the grids), at which signal strength is determined to be strongest within the respective one of the grids and identifying a strongest signal strength from among the grids. That is, signal locator 104 may be configured to adopt the two dimension search method as described with regard to FIG. 5 to identify the coordinates of a strongest signal strength within each of the selected grid. Signal locator 104 may then be configured to, during each of the two or more consecutive time intervals, compare the strongest signal strengths and identify coordinates corresponding to an overall strongest signal strength of a highest signal strength value among the strongest signal strengths. The overall strongest signal strength may be referred as global maximum signal strength. Signal locator 104 may be further configured to then direct one or more radio beams from antenna array 102 towards the coordinates corresponding to the overall strongest signal strength during the respective two or more consecutive time intervals. Processing may continue from block 610 to block 612.

Block 612 (Identify New Global Maximum Signal Strength) may refer to signal locator 104 identifying coordinates corresponding to a new overall strongest signal strength during a new time interval that follows the previous two or more time intervals. Block 612 may include one or more sub-processes indicated by block 614, 616, 618, 620.

Block 614 (Identify Multiple Local Max Signal Strengths) may refer to signal locator 104, during a new time interval, compiling two or more grids for each of the two or more previous consecutive time intervals and listing a strongest signal strength corresponding to each of the compiled two or more grids. In some examples, signal locator 104 may be configured to compile the grids that have been selected during the previous three intervals, e.g., grids 302A-302C, grids 304A-304D, grids 306A-306B, or to further select one or more additional grids. Signal locator 104 may then configured to search for a strongest signal strength within each of the nine or more grids. Processing may continue from block 614 to block 616.

Block 616 (Select Local Max Signal Strengths) may refer to signal locator 104 selecting a predetermined number, e.g., three, of the listed strongest signal strengths, in descending order, from the highest of the listed signal strengths. That is, signal locator 104, in some examples, may be configured to select the respective values and the respective coordinates of three highest signal strengths of the listed nine signal strengths respectively corresponding to grids 302A-302C, grids 304A-304D, grids 306A-306B. Processing may continue from block 616 to block 618.

Block 618 (Identify Multiple Grids) may refer to signal locator 104 identifying candidate grids corresponding to the predetermined number of the listed strongest signal strengths. In a non-limiting example, signal locator 104 may be configured to identify grids 302A, 304D, and 306B as the candidate grids if grids 302A, 304D, and 306B correspond to the selected three highest signal strengths. Processing may continue from block 618 to block 620.

Block 620 (Identify New Global Max Signal Strength) may refer to signal locator 104 identifying new coordinates within each of the two or more candidate grids, at which signal strength is determined to be strongest within the respective one of the two or more candidate grids and identifying a new strongest signal strength from among the two or more candidate grids. That is, signal locator 104 may be configured to identify coordinates of a new strongest signal strength within each of the candidate grids, e.g., grids 302A, 304D, and 306B. Further, signal locator 104 may be configured to identify coordinates of a new overall strongest signal strength from among the three new strongest signal strengths. The one or more radio beams from antenna array 102 may be redirected towards the identified new coordinates corresponding to the identified new overall strongest signal strength during the new time interval.

In at least one example embodiment, the aforementioned processing may revert to block 602 after a predetermined time intervals.

Figure 7:
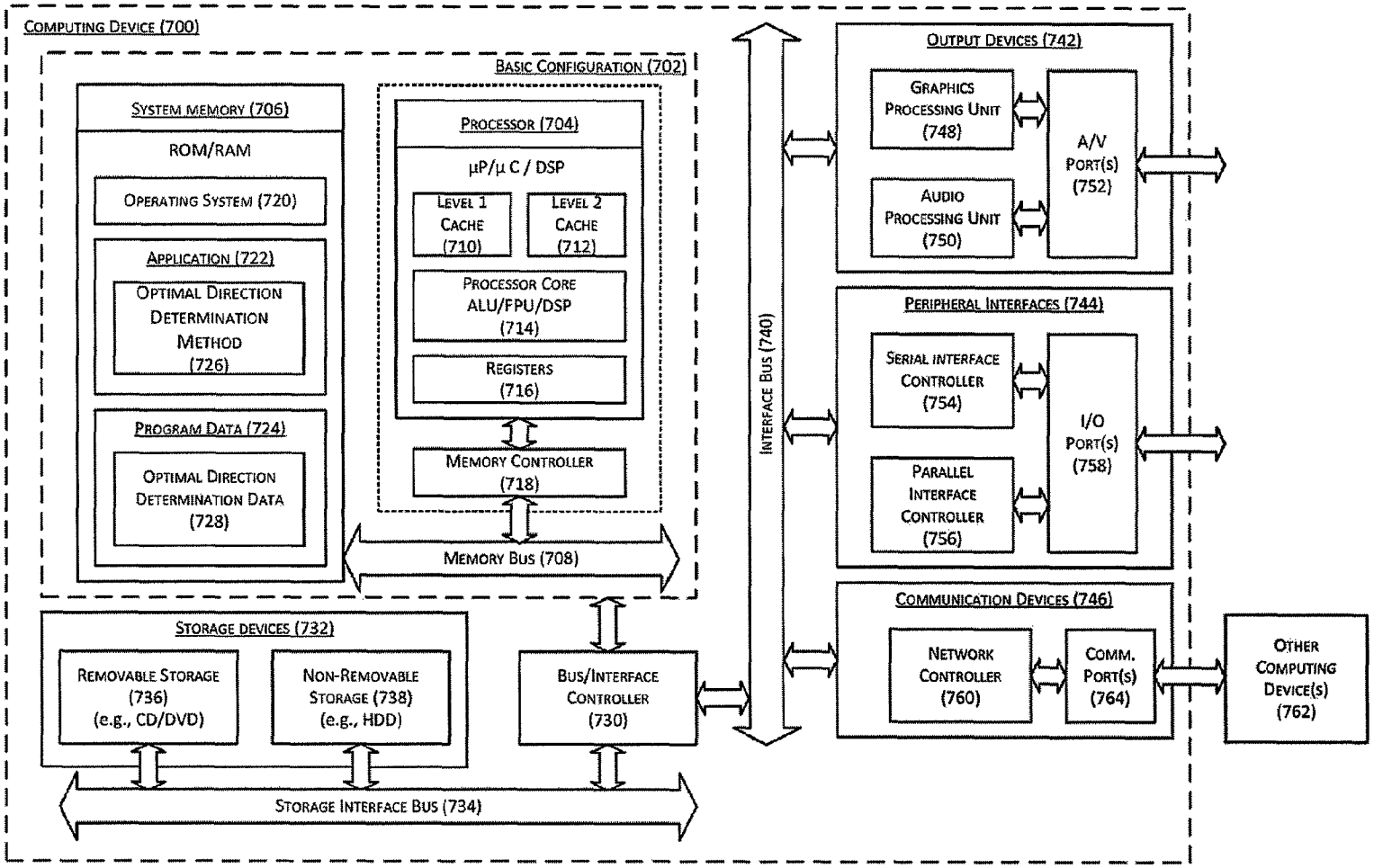
FIG. 7 shows a block diagram illustrating an example computing device that is arranged for optimal direction determination may be implemented, all arranged in accordance with at least some embodiments described herein.

FIG. 7 shows a block diagram illustrating an example computing device that is arranged for optimal direction determination may be implemented, arranged in accordance with at least some embodiments described herein.

In a very basic configuration 702, computing device 700 typically includes one or more processors 704 and a system memory 706. A memory bus 708 may be used for communicating between processor 704 and system memory 706.

Depending on the desired configuration, processor 704 may be of any type including but not limited to a microprocessor (μP), a microcontroller (μC), a digital signal processor (DSP), or any combination thereof. Processor 704 may include one more levels of caching, such as a level one cache 710 and a level two cache 712, a processor core 714, and registers 716. An example processor core 714 may include an arithmetic logic unit (ALU), a floating point unit (FPU), a digital signal processing core (DSP Core), or any combination thereof. An example memory controller 718 may also be used with processor 704, or in some implementations memory controller 718 may be an internal part of processor 704.

Depending on the desired configuration, system memory 706 may be of any type including but not limited to volatile memory (such as RAM), non-volatile memory (such as ROM, flash memory, etc.) or any combination thereof. System memory 706 may include an operating system 720, one or more applications 722, and program data 724. Application 722 may include an optimal direction determination method 726 that is arranged to perform the functions as described herein including those described with respect to processing flow 600 of FIG. 6. Program data 724 may include optimal direction determination data 728 that may be useful for operation with optimal direction determination method 726 as is described herein. In some embodiments, application 722 may be arranged to operate with program data 724 on operating system 720 such that implementations of optimal direction determination may be provided as described herein. This described basic configuration 702 is illustrated in FIG. 7 by those components within the inner dashed line.

Computing device 700 may have additional features or functionality, and additional interfaces to facilitate communications between basic configuration 702 and any required devices and interfaces. For example, a bus/interface controller 730 may be used to facilitate communications between basic configuration 702 and one or more data storage devices 732 via a storage interface bus 734. Data storage devices 732 may be removable storage devices 736, non-removable storage devices 738, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 706, removable storage devices 736 and non-removable storage devices 738 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 700. Any such computer storage media may be part of computing device 700.

Computing device 700 may also include an interface bus 740 for facilitating communication from various interface devices (e.g., output devices 742, peripheral interfaces 744, and communication devices 746) to basic configuration 702 via bus/interface controller 730. Example output devices 742 include a graphics processing unit 748 and an audio processing unit 750, which may be configured to communicate to various external devices such as a display or speakers via one or more A/V ports 752. Example peripheral interfaces 744 include a serial interface controller 754 or a parallel interface controller 756, which may be configured to communicate with external devices such as input devices (e.g., keyboard, mouse, pen, voice input device, touch input device, etc.) or other peripheral devices (e.g., printer, scanner, etc.) via one or more I/O ports 758. An example communication device 746 includes a network controller 760, which may be arranged to facilitate communications with one or more other computing devices 762 over a network communication link via one or more communication ports 764.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 700 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 700 may also be implemented as a personal computer including both laptop computer and non-laptop computer configurations.

In an illustrative embodiment, any of the operations, processes, etc. described herein can be implemented as computer-readable instructions stored on a computer-readable medium. The computer-readable instructions can be executed by a processor of a mobile unit, a network element, and/or any other computing device.

There is little distinction left between hardware and software implementations of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats.

However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a CD, a DVD, a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc."

is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

We claim:

1. A method to direct an antenna array, comprising:

identifying boundaries of a signal spectrum in a spherical space;

parsing the signal spectrum into multiple grids in accordance with respective variable values of an azimuth and elevation of the antenna array;

identifying two or more consecutive time intervals;

selecting two or more of the multiple grids for each of the two or more consecutive time intervals;

identifying coordinates within each of the two or more grids, at which signal strength is determined to be strongest within the respective one of the two or more grids;

identifying a strongest signal strength from among the two or more grids; and directing one or more radio beams towards the identified coordinates corresponding to the identified strongest signal strength during the respective two or more consecutive time intervals.

2. The method of claim 1, further comprising, for a new time interval:

compiling the two or more grids for each of the two or more consecutive time intervals;

listing a strongest signal strength corresponding to each of the compiled two or more grids;

selecting a predetermined number of the listed strongest signal strengths, in descending order, from the highest of the listed signal strengths;

identifying candidate grids corresponding to the predetermined number of the listed strongest signal strengths;

identifying new coordinates within each of the two or more candidate grids, at which signal strength is determined to be strongest within the respective one of the two or more candidate grids;

identifying a new strongest signal strength from among the two or more candidate grids; and redirecting the one or more radio beams towards the identified new coordinates corresponding to the identified new strongest signal strength during the new time interval.

3. The method of claim 1, wherein the size of each of the multiple grids is determined by an aperture of each antenna of the antenna array.

4. The method of claim 1, wherein the identifying coordinates within each of the two or more grids includes:

(a) selecting a fixed value for the azimuth of the grid;

(b) changing the elevation to locate a first one-dimensional maximum signal strength corresponding to the fixed value;

(c) determining an elevation value corresponding to the first one-dimensional maximum signal strength;

(d) changing the azimuth to locate a second one-dimensional maximum signal strength corresponding to the elevation value; and (e) repeating (b) through (d) until the second one-dimensional maximum signal strength is not greater than the first one-dimensional maximum signal strength.

5. The method of claim 4, wherein the changing the elevation to locate a first one-dimensional maximum power corresponding to the fixed value is in accordance with Golden Section search.

6. The method of claim 1, wherein the antenna array includes multiple antennas that are configured to form multiple directional beams to transmit one or more wireless signals.

7. A non-transitory computer-readable medium that stores executable-instructions that, when executed, cause one or more processors to perform operations including:

identifying a strongest signal strength for each of two or more consecutive time intervals by:

identifying boundaries of a signal spectrum in a spherical space, and parsing the signal spectrum into multiple grids in accordance with respective variable values of an azimuth and elevation of an antenna array;

directing one or more radio beams towards coordinates corresponding to the identified strongest signal strength;

identifying a new strongest signal strength during a new time interval; and redirecting the one or more radio beams towards new coordinates corresponding to the identified new strongest signal strength.

8. The non-transitory computer-readable medium of claim 7, wherein the identifying a strongest signal strength for each of two or more consecutive time intervals further includes:

randomly selecting two or more grids from the multiple grids;

identifying coordinates within each of the two or more grids, at which signal strength is determined to be strongest within the respective one of the two or more grids; and identifying the strongest signal strength from among the two or more grids.

9. The non-transitory computer-readable medium of claim 8, wherein the size of each of the multiple grids is determined by an aperture of each antenna of the antenna array.

10. The non-transitory computer-readable medium of claim 8, wherein the identifying coordinates within each of the two or more grids includes:

(a) selecting a fixed value for the elevation of the grid;

(b) changing the azimuth to locate a first one-dimensional maximum signal strength corresponding to the fixed value;

(c) determining an azimuth value corresponding to the first one-dimensional maximum signal strength;

(d) changing the elevation to locate a second one-dimensional maximum signal strength corresponding to the azimuth value; and (e) repeating (b) through (d) until the second one-dimensional maximum signal strength is not greater than the first one-dimensional maximum signal strength.

11. The non-transitory computer-readable medium of claim 10, wherein the changing the azimuth to locate a first one-dimensional maximum power corresponding to the fixed value is in accordance with Golden Section search.

12. The non-transitory computer-readable medium of claim 8, wherein the antenna array includes multiple antennas that are configured to form multiple directional beams to transmit one or more wireless signals.

13. The non-transitory computer-readable medium of claim 7, wherein the identifying a new strongest signal strength during a new time interval includes:

compiling the two or more grids for each of the two or more consecutive time intervals;

listing a strongest signal strength corresponding to each of the compiled two or more grids;

selecting a predetermined number of the listed strongest signal strengths, in descending order, from the highest of the listed signal strengths;

identifying candidate grids corresponding to the predetermined number of the listed strongest signal strengths;

identifying new coordinates within each of the two or more candidate grids, at which signal strength is determined to be strongest within the respective one of the two or more candidate grids;

identifying the new strongest signal strength from among the two or more candidate grids; and redirecting the one or more radio beams towards the identified new coordinates corresponding to the identified new strongest signal strength during the new time interval.

14. An antenna array, comprising:

a signal locator configured to:

identify boundaries of a signal spectrum, identify coordinates of a comparative reading of strongest signal strength within the signal spectrum, and parse the signal spectrum into multiple grids in accordance with respective variable values of an azimuth and elevation of the antenna array; and multiple antennas configured to:

direct one or more radio signals towards the identified coordinates.

15. The antenna array of claim 14, wherein the signal locator is further configured to:

randomly select two or more of the multiple grids for each of two or more consecutive time intervals;

identify coordinates within each of the two or more grids, at which signal strength is determined to be strongest within the respective one of the two or more grids;

identify the strongest signal strength from among the two or more grids; and direct one or more radio signals towards the identified coordinates corresponding to the identified strongest signal strength during the respective two or more consecutive time intervals.

16. The antenna array of claim 15, wherein the signal locator, for a new time interval, is further configured to:

compile the two or more grids for each of the two or more consecutive time intervals;

list a strongest signal strength corresponding to each of the compiled two or more grids;

select a predetermined number of the listed strongest signal strengths, in descending order, from the highest of the listed signal strengths;

identify candidate grids corresponding to the predetermined number of the listed strongest signal strengths;

identify new coordinates within each of the two or more candidate grids, at which signal strength is determined to be strongest within the respective one of the two or more candidate grids;

identify a new strongest signal strength from among the two or more candidate grids; and redirect the one or more radio signals towards the identified new coordinates corresponding to the identified new strongest signal strength during the new time interval.

17. The antenna array of claim 15, wherein the signal locator is further configured to:

(a) select a fixed value for the azimuth of the grid;

(b) change the elevation to locate a first one-dimensional maximum signal strength corresponding to the fixed value;

(c) determine an elevation value corresponding to the first one-dimensional maximum signal strength;

(d) change the azimuth to locate a second one-dimensional maximum signal strength corresponding to the elevation value; and (e) repeat (b) through (d) until the second one-dimensional maximum signal strength is not greater than the first one-dimensional maximum signal strength.

18. The antenna array of claim 14, wherein the size of each of the multiple grids is determined by an aperture of each antenna of the antenna array.

* * * * *